US011365583B2

(12) United States Patent
Tao

(10) Patent No.: US 11,365,583 B2
(45) Date of Patent: Jun. 21, 2022

(54) ROLLER BLIND ALLOWING UPPER AND LOWER POSITION LIMITS TO BE SET AND DAMPER THEREOF

(71) Applicant: SUNMASTER BLINDS CO., LTD., Kaohsiung (TW)

(72) Inventor: Yi-Chin Tao, Kaohsiung (TW)

(73) Assignee: Sunmaster Blinds Co., Ltd., Kaohsiung (TW)

( * ) Notice: Subject to any disclaimer, the term of this patent is extended or adjusted under 35 U.S.C. 154(b) by 10 days.

(21) Appl. No.: 17/007,544

(22) Filed: Aug. 31, 2020

(65) Prior Publication Data

US 2022/0065041 A1 Mar. 3, 2022

(51) Int. Cl.
*E06B 9/80* (2006.01)
*E06B 9/42* (2006.01)

(52) U.S. Cl.
CPC . *E06B 9/80* (2013.01); *E06B 9/42* (2013.01)

(58) Field of Classification Search
CPC ..... E06B 9/80; E06B 9/42; E06B 9/72; E06B 9/68; E06B 2009/6809; E06B 2009/802; E06B 9/322; E06B 9/90; A47H 5/00
USPC ..... 160/293.1
See application file for complete search history.

(56) References Cited

U.S. PATENT DOCUMENTS

2015/0284999 A1* 10/2015 Liu ..... E06B 9/80 242/396
2016/0083999 A1* 3/2016 Chen ..... E06B 9/42 160/315
2016/0290043 A1* 10/2016 McPherson, Jr. ..... E06B 9/78
2020/0123853 A1* 4/2020 Chen ..... E06B 9/90
2021/0156196 A1* 5/2021 Tao ..... E06B 9/82

* cited by examiner

*Primary Examiner* — Beth A Stephan
(74) *Attorney, Agent, or Firm* — Rosenberg, Klein & Lee

(57) ABSTRACT

Disclosed is a roller blind allowing an upper position limit and a lower position limit to be set by the damper of the roller blind. The damper allows the upper position limit and the lower position limit to be set and includes an inner tube, a first sliding base, a first position-limiting base, and a second position-limiting base. When a blind fabric is driven by a linkage assembly, the first sliding base is driven by the linkage assembly and ends up pushed against the first position-limiting base or the second position-limiting base to stop the linkage assembly from driving the blind fabric. The blind fabric can therefore be limited in position whether it is raised or lowered.

10 Claims, 14 Drawing Sheets

ROLLER BLIND ALLOWING UPPER AND LOWER POSITION LIMITS TO BE SET AND DAMPER THEREOF

BACKGROUND OF THE INVENTION

1. Technical Field

The present invention relates to a roller blind and its damper. More particularly, the invention relates to a roller blind that allows an upper position limit and a lower position limit to be set by the damper of the roller blind.

2. Description of Related Art

When lowering the blind fabric of a relatively large roller blind, the weight of the blind fabric may damage the roller body if the blind fabric is let down too rapidly. Without proper damping or position limitation, the weight of the blind fabric may be concentrated at the joint between the blind fabric and the roller body as soon as the blind fabric is lowered, thus damaging or even splitting the blind fabric. The blind fabric may also separate from the roller body if lowered excessively.

In light of the above, the inventor of the present invention developed a roller blind whose blind fabric can be rapidly lowered and a control device for the roller blind, and was granted therefor Taiwan Patent No. M591815. In this patented roller blind, a solenoid valve can drive a pushing mechanism to push a front cap out of engagement with an engaging portion when supplied with electricity, and a reeling mechanism can work despite the resistance of a damping member and allow the blind fabric of the roller blind to fall rapidly under the action of gravity, without being subjected by the resistance of the damping member. Once the blind fabric is let down, the position of the blind fabric is limited by a position-limiting mechanism so that the blind fabric will not be lowered excessively.

The patented roller blind, however, provides position limitation only during the blind fabric lowering process. If one who is raising the blind fabric fails to pay due attention and keeps lifting the blind fabric, the bottom rail connected to the lower end of the blind fabric may hit the roller body and be damaged as a result, or even worse, it is the roller body that gets damaged.

BRIEF SUMMARY OF THE INVENTION

Hence, the inventor of the present invention provides a damper that allows an upper position limit and a lower position limit to be set, and that can be used to limit the positions of a blind fabric that can be driven by a linkage assembly in order to be raised or lowered. The damper includes an inner tube, a first sliding base, a first position-limiting base, and a second position-limiting base. The inner tube is provided in the linkage assembly. The first sliding base is provided on the inner tube, is coupled to the linkage assembly, and is driven to rotate and displace on the inner tube by the linkage assembly. The first position-limiting base is provided on the inner tube and is adjacent to a first side of the first sliding base. The second position-limiting base is provided on the inner tube and is adjacent to the opposite second side of the first sliding base. When the blind fabric is lowered by the linkage assembly, the first sliding base is driven to rotate and displace on the inner tube toward the first position-limiting base by the linkage assembly, and when the first sliding base is pushed against the first position-limiting base, the first position-limiting base causes the first sliding base to stop the linkage assembly from lowering the blind fabric. When the blind fabric is raised by the linkage assembly on the other hand, the first sliding base is driven to rotate and displace on the inner tube toward the second position-limiting base by the linkage assembly, and when the first sliding base is pushed against the second position-limiting base, the second position-limiting base causes the first sliding base to stop the linkage assembly from raising the blind fabric.

The inventor also provides a roller blind that allows an upper position limit and a lower position limit to be set, and that can be used to limit the positions of a blind fabric. The roller blind includes a linkage assembly in addition to the foregoing damper that allows an upper position limit and a lower position limit to be set. The linkage assembly includes an outer tube connected to the blind fabric so that the outer tube can drive the blind fabric and thereby raise or lower the blind fabric.

Preferably, the first position-limiting base includes a second sliding base and a damping elastic member, and the damping elastic member is provided between the inner tube and the second sliding base. When the first sliding base is pushed against the second sliding base, the damping elastic member stores damping elastic potential energy and stops the second sliding base from being rotated. When the first sliding base is moved away from the second sliding base, the damping elastic member releases the damping elastic potential energy to bring the second sliding base back to its original position.

Preferably, the outer tube has a position-limiting ridge, the inner tube has a first threaded portion, and the first sliding base has a position-limiting portion corresponding to the position-limiting ridge and a second threaded portion meshing with the first threaded portion of the inner tube. When rotated, the outer tuber drives the first sliding base to rotate and displace on the inner tube along the first threaded portion and the position-limiting ridge.

Preferably, the second position-limiting base includes a third sliding base and a securing member, and the securing member is provided on the third sliding base and abuts against the first threaded portion of the inner tube. When the first sliding base is pushed against the third sliding base, the securing member is pressed tightly against the first threaded portion to stop the third sliding base from being rotated.

Preferably, the first side of the first sliding base has a first coupling portion, the second side of the first sliding base has a second coupling portion, the first position-limiting base has a third coupling portion, and the second position-limiting base has a fourth coupling portion. The first coupling portion of the first sliding base is coupled with the third coupling portion of the first position-limiting base when the first sliding base is pushed against the first position-limiting base, and the second coupling portion of the first sliding base is coupled with the fourth coupling portion of the second position-limiting base when the first sliding base is pushed against the second position-limiting base.

The technical features stated above can produce the following effects:

1. By providing the first position-limiting base and the second position-limiting base on two opposite sides of the first sliding base respectively, the blind fabric will be limited in position whether it is being lowered or raised, so there is no need to worry that the blind fabric may be damaged by being lowered or raised to an excessive extent.

2. As the first position-limiting base includes the second sliding base and the damping elastic member, the first sliding base can engage with the second sliding base when pushed against it, in order for the damping elastic member to effectively damp the huge impact caused by the blind fabric being lowered.

3. As the second position-limiting base includes the third sliding base and the securing member, the first sliding base can also engage with the third sliding base in order for the securing member to stop the third sliding base from being rotated.

DETAILED DESCRIPTION OF THE INVENTION

Figure 1:
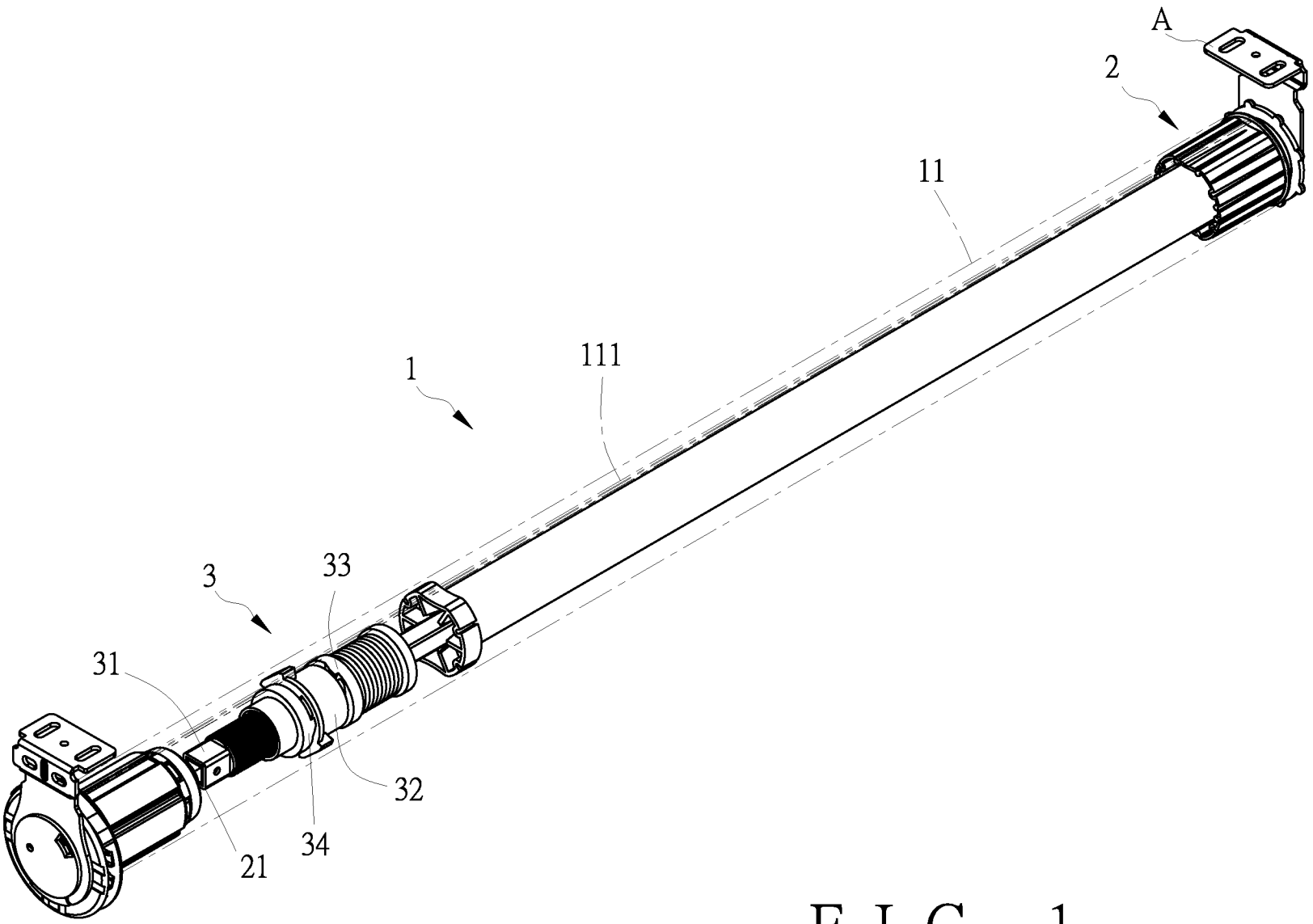
FIG. 1 is an assembled perspective view of a roller blind that allows an upper position limit and a lower position limit to be set.
Figure 2:
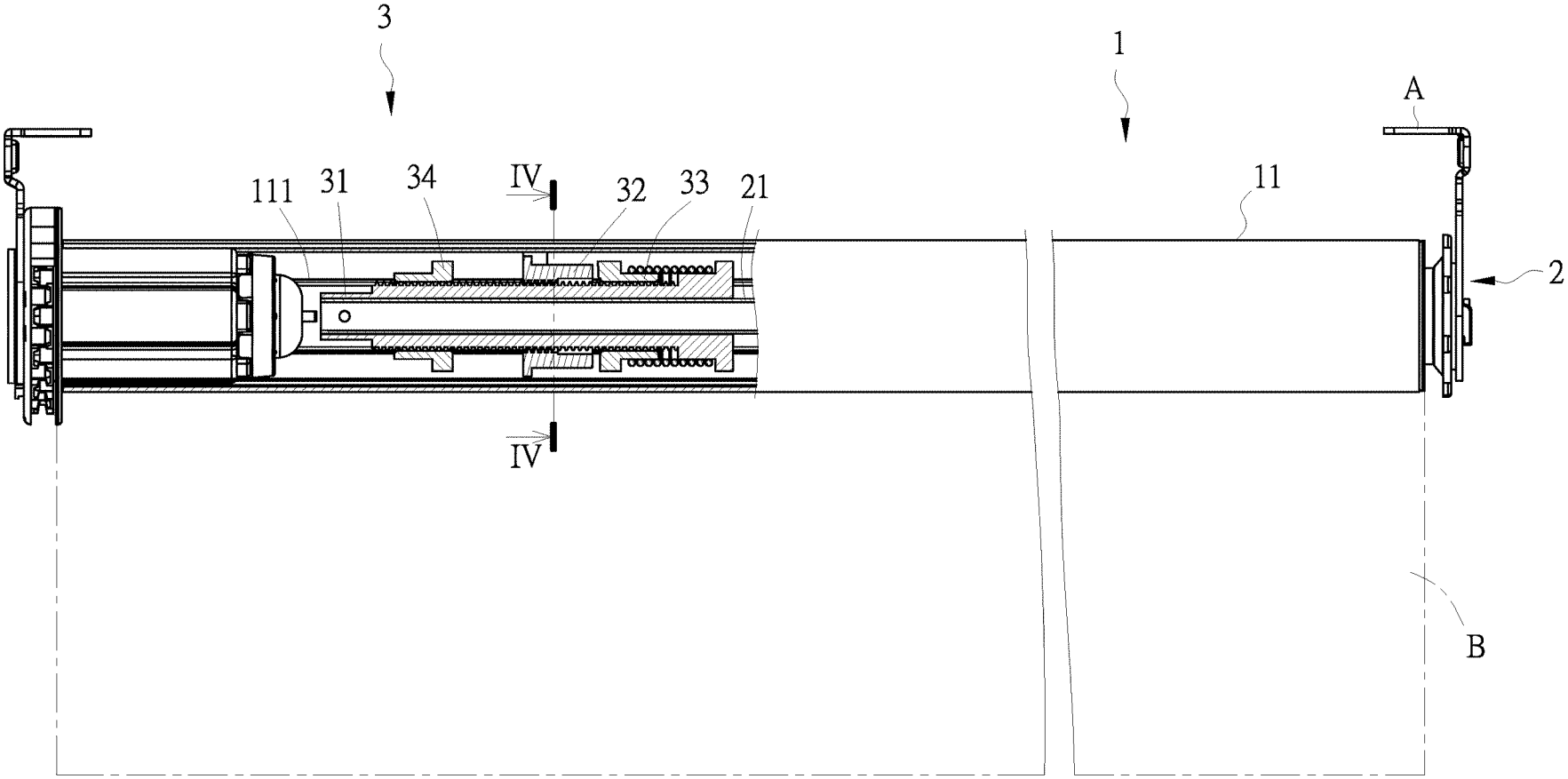
FIG. 2 is a sectional view of the roller blind in FIG. 1.

The technical features stated above are incorporated into the roller blind of the present invention and its damper, wherein the roller blind allows an upper position limit and a lower position limit to be set. The major effects of the roller blind and the damper are demonstrated by the following embodiment.

Please refer to FIG. 1 to FIG. 4 for a roller blind according to the present invention, which allows an upper position limit and a lower position limit to be set. The roller blind that allows an upper position limit and a lower position limit to be set can be hung on a ceiling or a wall by means of a bracket A and limit the positions of a blind fabric B. The roller blind that allows an upper position limit and a lower position limit to be set includes a linkage assembly 1, a securing assembly 2, and a damper 3 that allows the upper position limit and the lower position limit to be set. The linkage assembly 1 includes an outer tube 11, and the outer tube 11 is connected to and can drive the blind fabric B. The securing assembly 2 is provided at one end of the outer tube 11 and is secured on the bracket A. The securing assembly 2 includes a rod member 21.

The damper 3 allowing the upper position limit and the lower position limit to be set includes an inner tube 31, a first sliding base 32, a first position-limiting base 33, and a second position-limiting base 34.

The inner tube 31 is provided in the outer tube 11 and is mounted around the rod member 21. In this embodiment, both the inner tube 31 and the rod member 21 are tubes with a square cross section. The inner tube 31 and the rod member 21 can be secured together by a threaded member, for example, to prevent relative movement or rotation between the inner tube 31 and the rod member 21.

The first sliding base 32 has a second threaded portion 321 and a position-limiting portion 322. The second threaded portion 321 meshes with a first threaded portion 311 of the inner tube 31. The position-limiting portion 322 is engaged with a plurality of position-limiting ridges 111 that are arranged at intervals on the inner periphery of the outer tube 11.

The first position-limiting base 33 includes a second sliding base 331 and a damping elastic member 332. The second sliding base 331 is mounted around the inner tube 31. The second sliding base 331 has a third coupling portion 3311 corresponding to a first coupling portion 323 on one side of the first sliding base 32. The damping elastic member 332 is coupled to the second sliding base 331 at one end (hereinafter referred to as the first end) and is coupled to a securing portion 312 of the inner tube 31 at the other end (hereinafter referred to as the second end).

The second position-limiting base 34 includes a third sliding base 341 and a securing member 342. The third sliding base 341 is mounted around the inner tube 31. The third sliding base 341 has a fourth coupling portion 3411 corresponding to a second coupling portion 324 on the other side of the first sliding base 32. The securing member 342 is provided in a through hole 3412 in the third sliding base 341 and abuts against the first threaded portion 311. In this embodiment, the first coupling portion 323, the second coupling portion 324, the third coupling portion 3311, and the fourth coupling portion 3411 are all protruding blocks, and the securing member 342 is a threaded member.

The lower position limit is explained below with reference to FIG. 2 to FIG. 6. When rotated to let down the blind fabric B, the outer tube 11 drives the first sliding base 32 to rotate and displace on the inner tube 31 toward the second sliding base 331 along the first threaded portion 311 and the position-limiting ridges 111.

When the first sliding base 32 is pushed against the second sliding base 331, referring to FIG. 2, FIG. 3, and FIG. 6 to FIG. 8, the first coupling portion 323 of the first sliding base 32 is engaged with the third coupling portion 3311 of the second sliding base 331. In this state, the first end of the damping elastic member 332 is rotated by the second sliding base 331 while the second end of the damping elastic portion 332 remains secured on the securing portion 312 of the inner tube 31. As the inner tube 31 is restricted by the rod member 21 and cannot be rotated or displaced, the damping elastic member 332 stores damping elastic potential energy and stops the second sliding base 331 from being rotated. The first sliding base 32, in turn, is restricted by the second sliding base 331 and stops rotating, too. Consequently, the position-limiting ridges 111 of the outer tube 11 are restricted by the position-limiting portion 322 of the first sliding base 32, and the outer tube 11 cannot be rotated any further. The blind fabric B, therefore, ceases to be lowered, i.e., has reached the lower position limit, and the huge impact generated by the blind fabric B being lowered has been effectively damped by the damping elastic member 332.

Once the blind fabric B reaches the lower position limit, referring to FIG. 6 to FIG. 9, the outer tube 11 can be rotated in the reverse direction to raise the blind fabric B. The outer tube 11 will drive the first sliding base 32 away from the second sliding base 331, allowing the second sliding base 331 to return to its original position in response to the damping elastic member 332 releasing the damping elastic potential energy.

Figure 3:
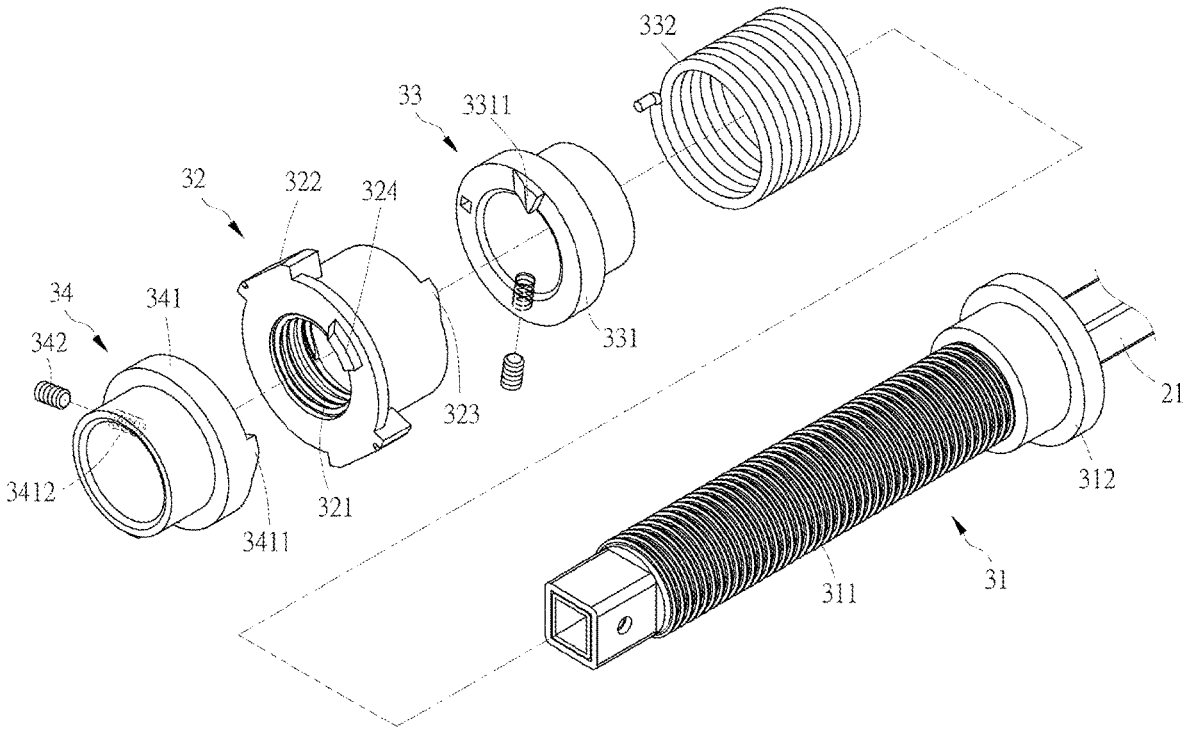
FIG. 3 is an exploded perspective view of the damper of the roller blind in FIG. 1, wherein the damper allows the upper position limit and the lower position limit to be set.
Figure 4:
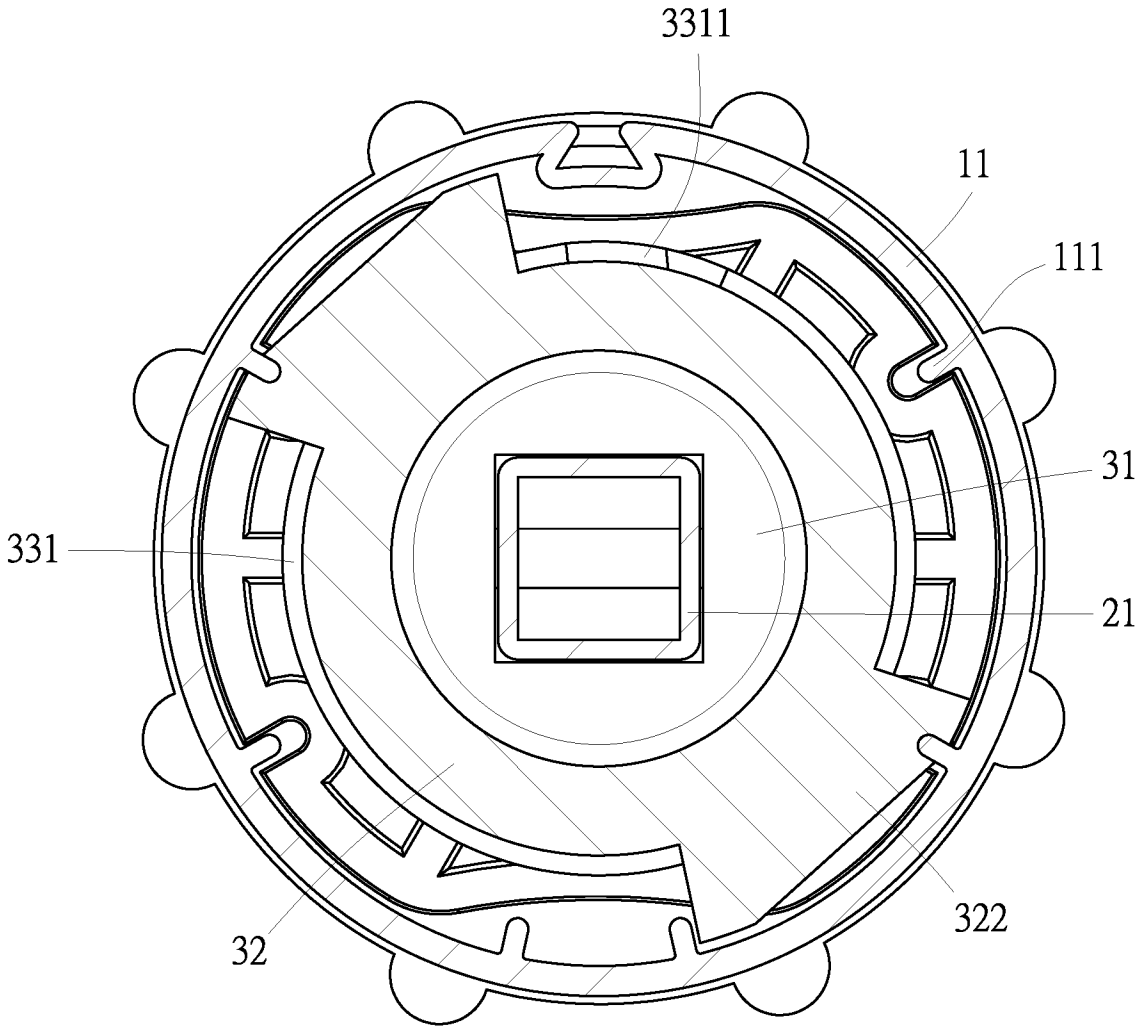
FIG. 4 is a sectional view of the roller blind in FIG. 1, showing in particular the damper in the assembled state.
Figure 5:
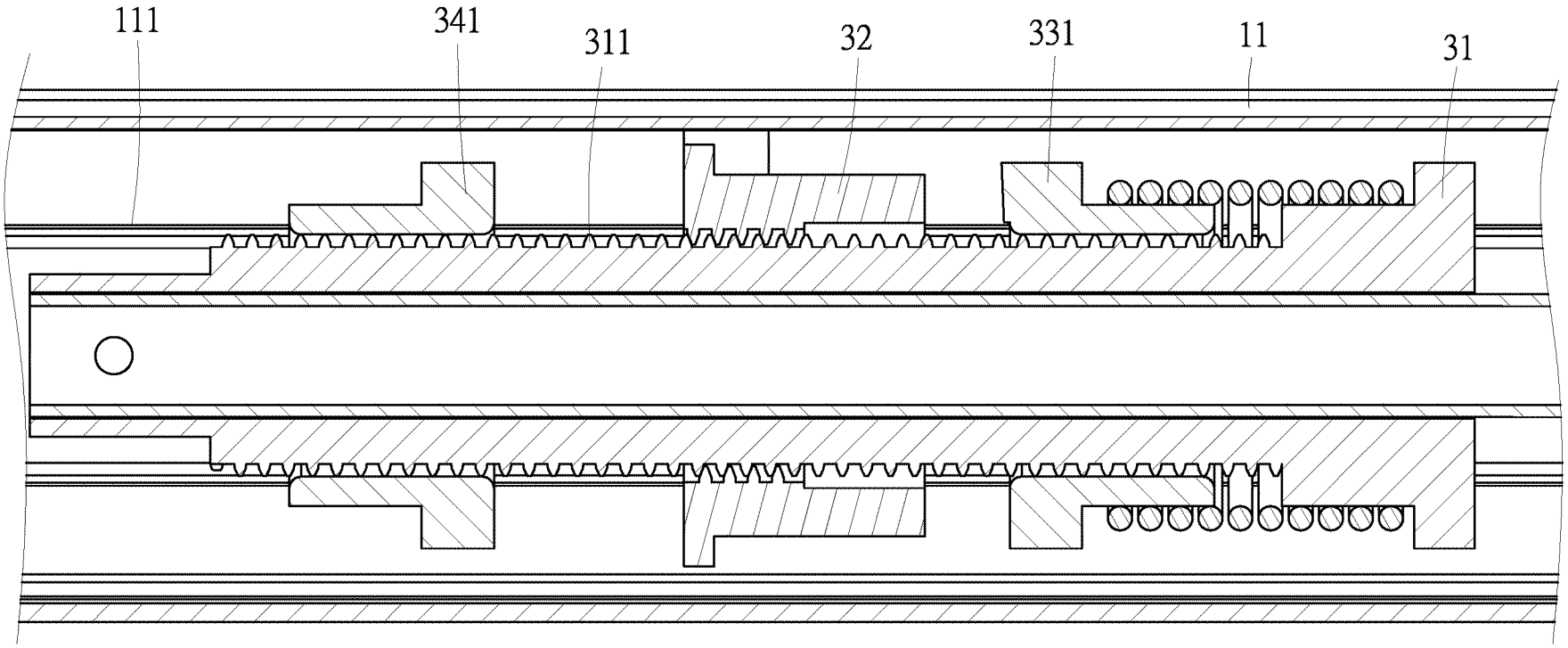
FIG. 5 is a sectional view showing a state of use of the roller blind in FIG. 1, with the first sliding base not yet moved.
Figure 6:
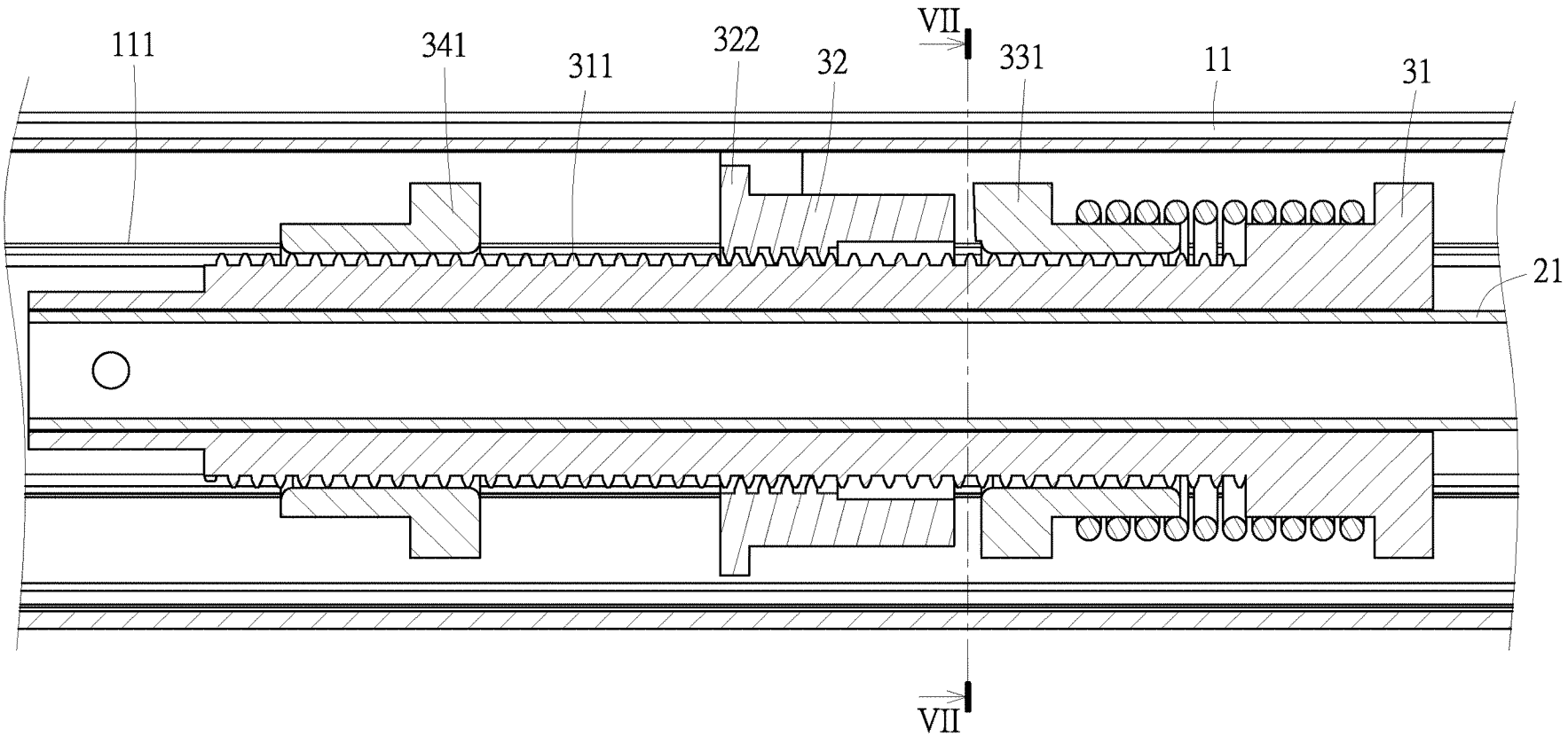
FIG. 6 is a sectional view showing another state of use of the roller blind in FIG. 1, with the first sliding base pushed against the second sliding base.
Figure 7:
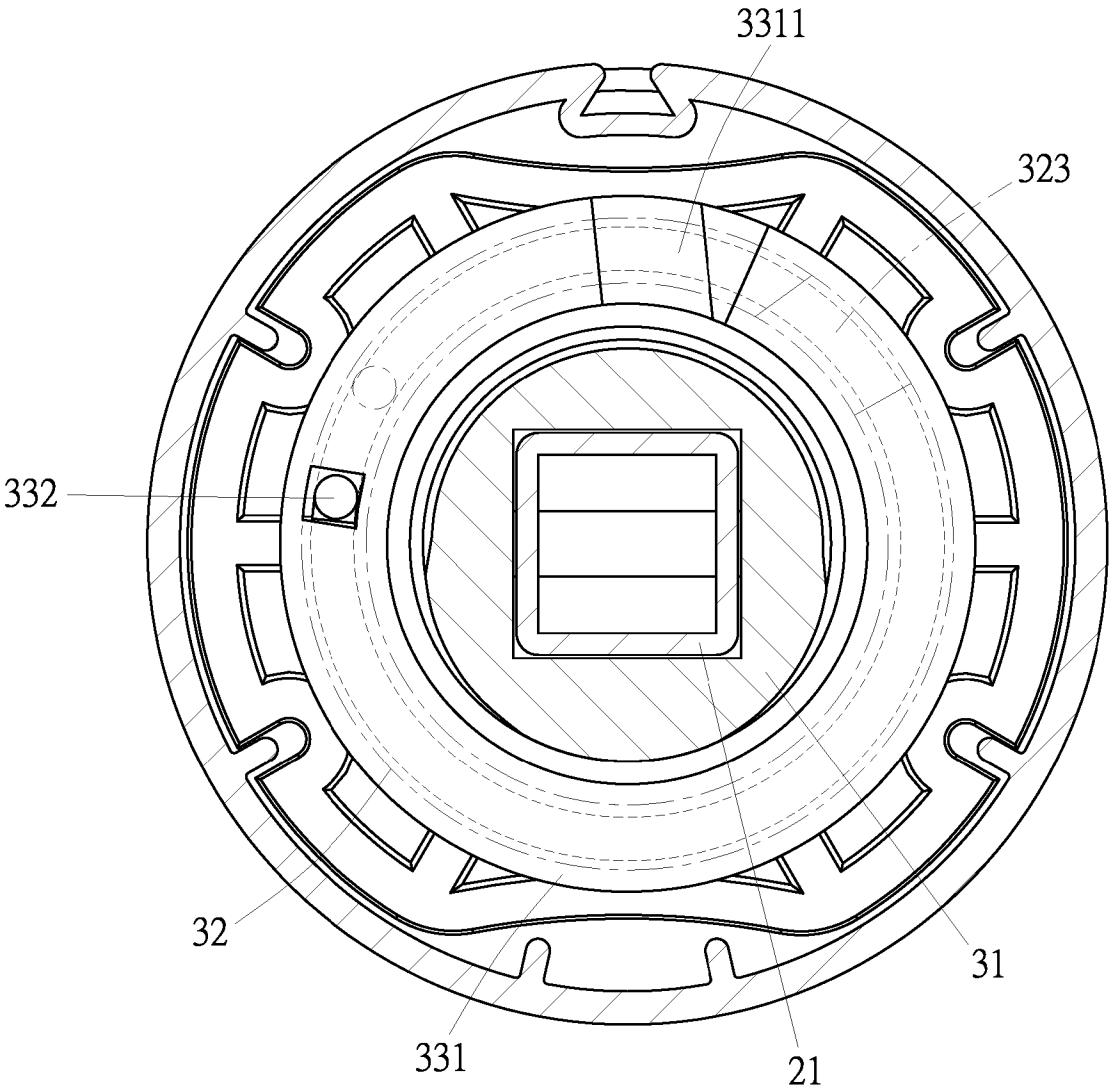
FIG. 7 is a sectional view corresponding to the state in FIG. 5, showing in particular the state of the damping elastic member when the first sliding base has yet to be moved.
Figure 8:
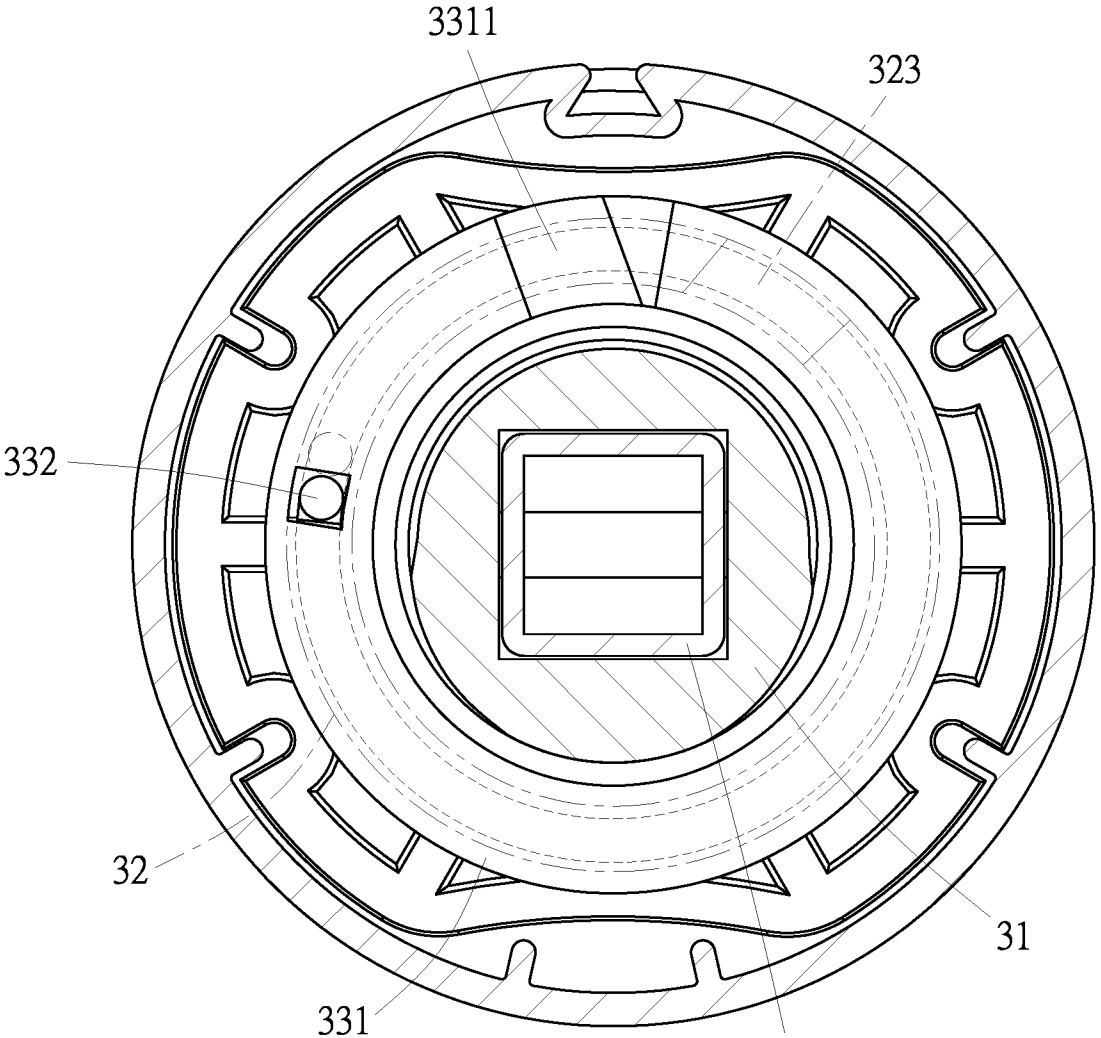
FIG. 8 is a sectional view corresponding to the state in FIG. 6, showing in particular the state of the damping elastic member when the first sliding base is pushed against the second sliding base.
Figure 9:
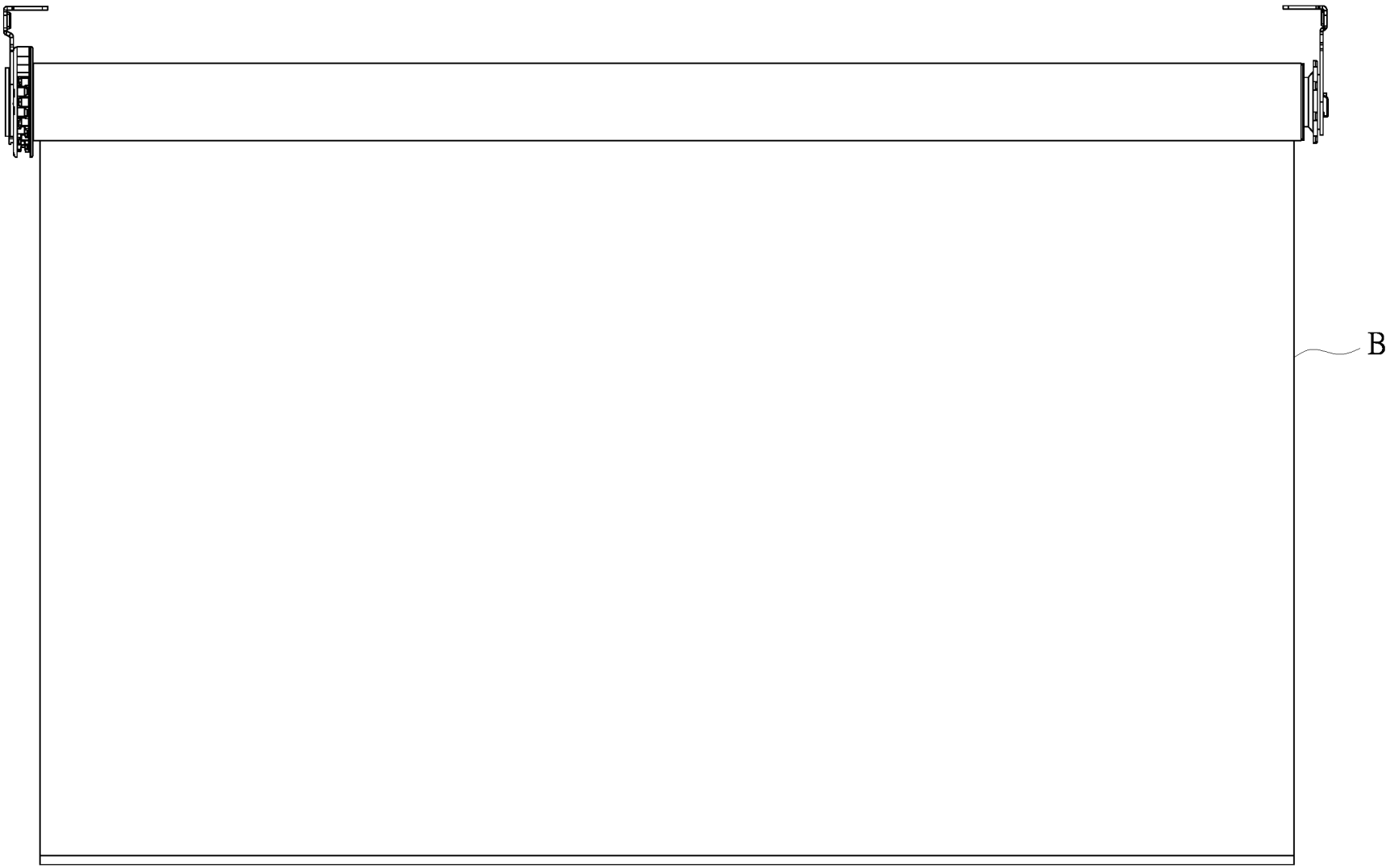
FIG. 9 shows an application of the roller blind in FIG. 1, with the blind fabric reaching the lower position limit.
Figure 10:
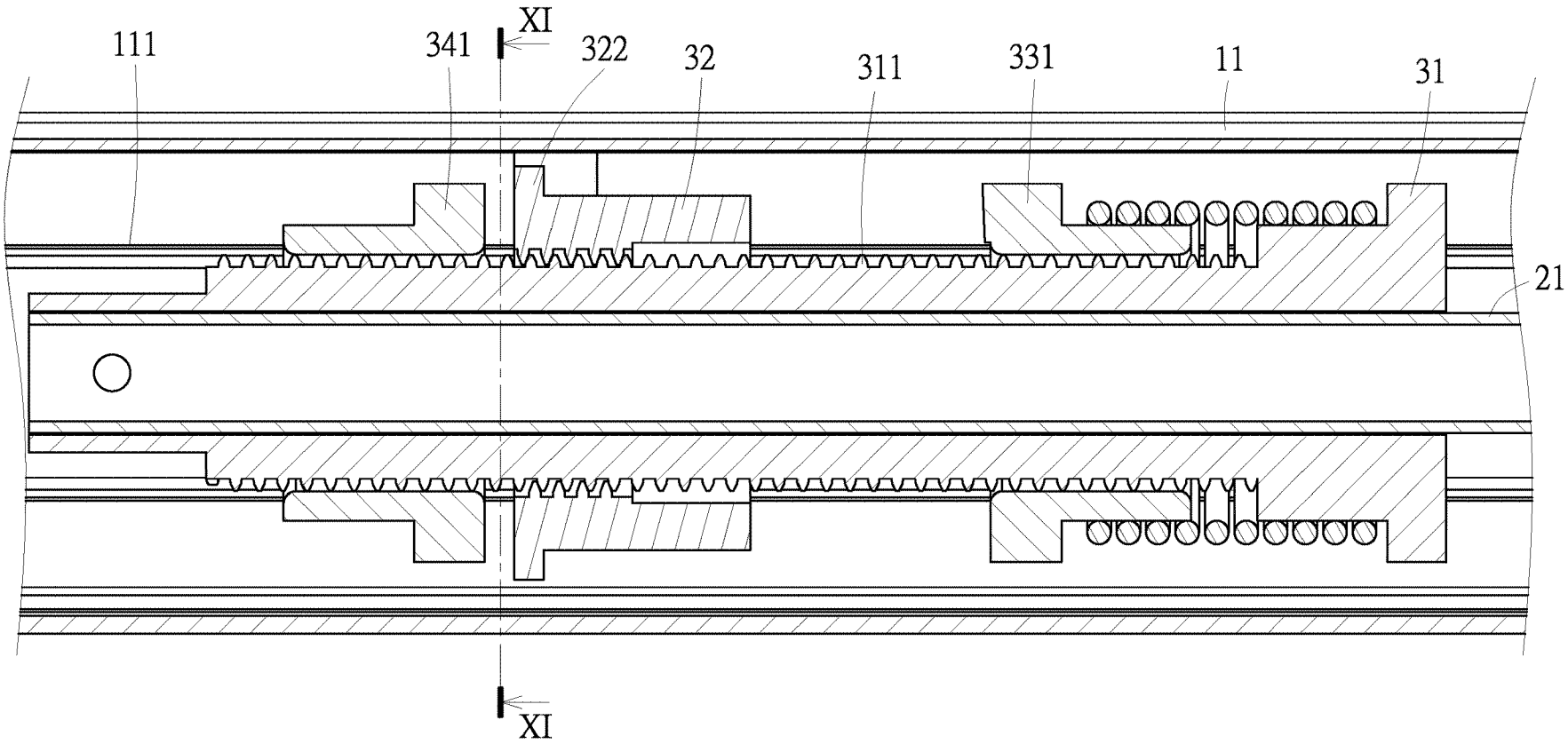
FIG. 10 is a sectional view showing yet another state of use of the roller blind in FIG. 1, with the first sliding base pushed against the third sliding base.
Figure 11:
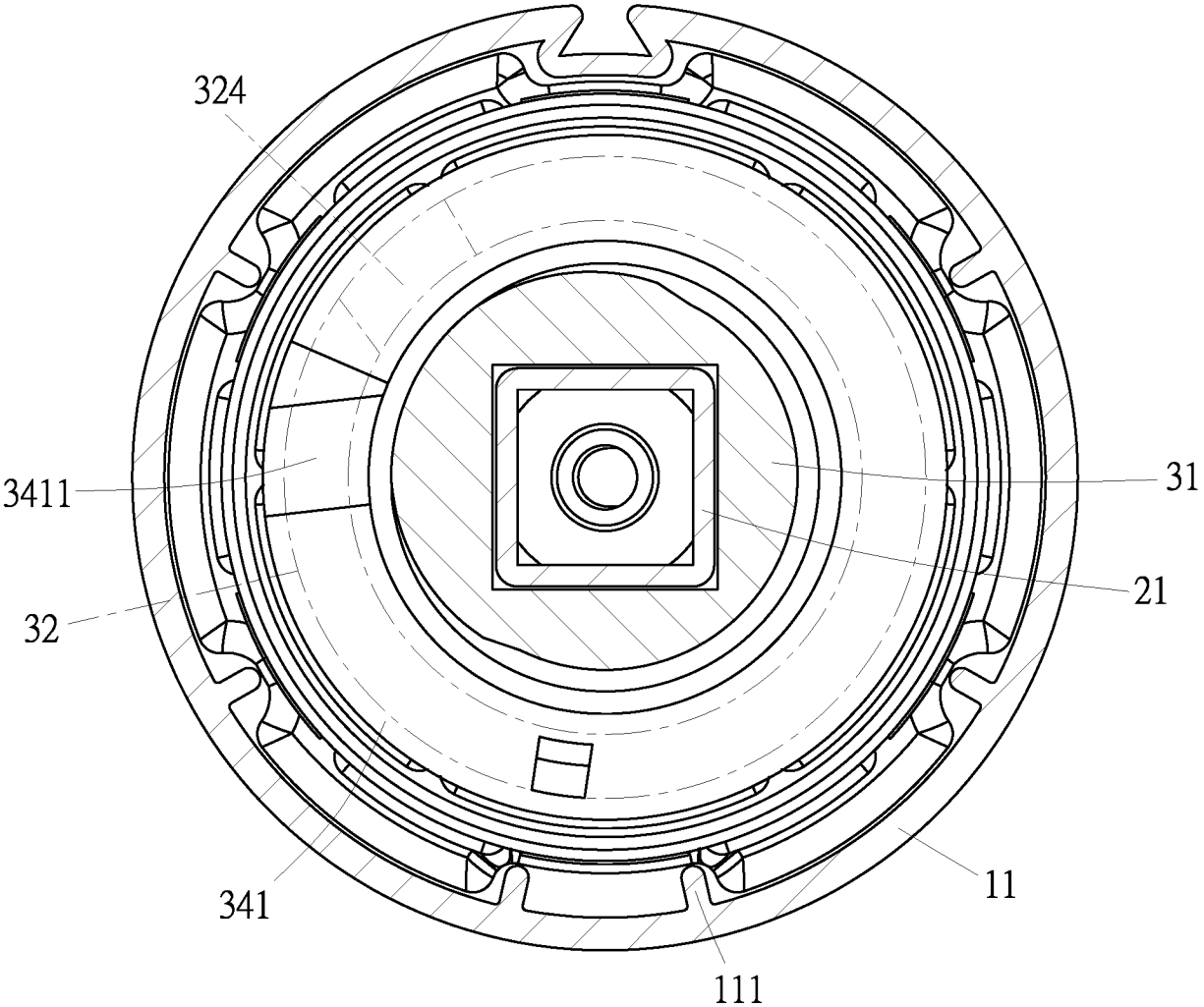
FIG. 11 is a sectional view corresponding to the state in FIG. 10, showing in particular the second coupling portion engaged with the fourth coupling portion when the first sliding base is pushed against the third sliding base.
Figure 12:
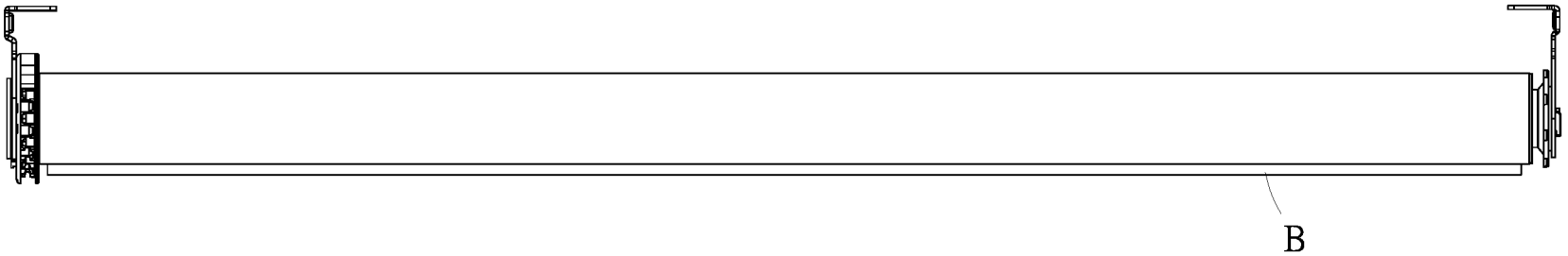
FIG. 12 shows another application of the roller blind in FIG. 1, with the blind fabric reaching the upper position limit.

The upper position limit is explained below with reference to FIG. 10 to FIG. 12 in conjunction with FIG. 3. By rotating the outer tube 11 further in the aforesaid reverse direction, the outer tube 11 will push the first sliding base 32 against the third sliding base 341 such that the second coupling portion 324 of the first sliding base 32 is engaged with the fourth coupling portion 3411 of the third sliding base 341. The securing member 342 in this state is pressed tightly against the first threaded portion 311 of the inner tube 31 and thus stops the third sliding base 341 from being rotated. The first sliding base 32, in turn, is restricted by the third sliding base 341 and stops rotating, too. As a result, the position-limiting ridges 111 of the outer tube 11 are restricted by the position-limiting portion 322 of the first sliding base 32, and the outer tube 11 cannot be rotated any further. The blind fabric B, therefore, ceases to be raised, i.e., has reached the upper position limit.

Figure 13:
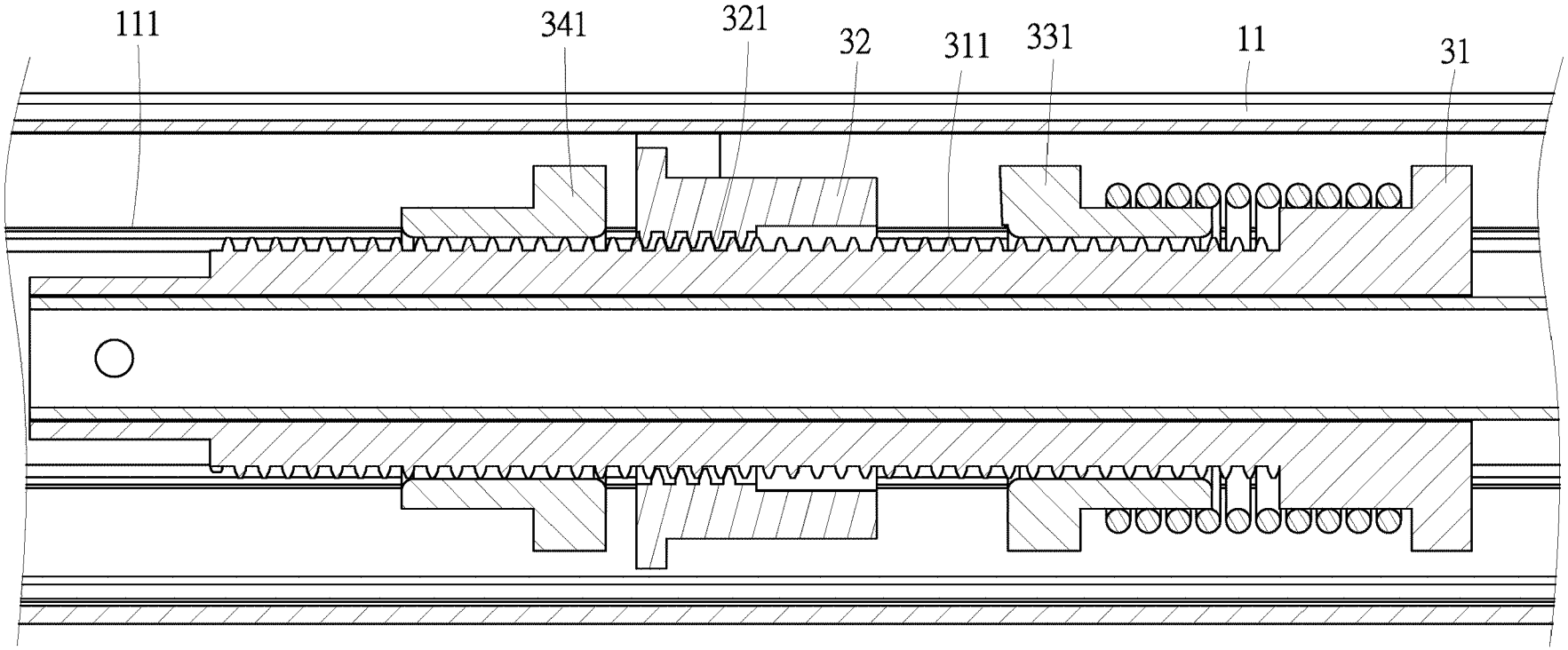
FIG. 13 is a sectional view showing still another state of use of the roller blind in FIG. 1, with the third sliding base at a different position from that in FIG. 10, and with the first sliding base pushed against the third sliding base.
Figure 14:
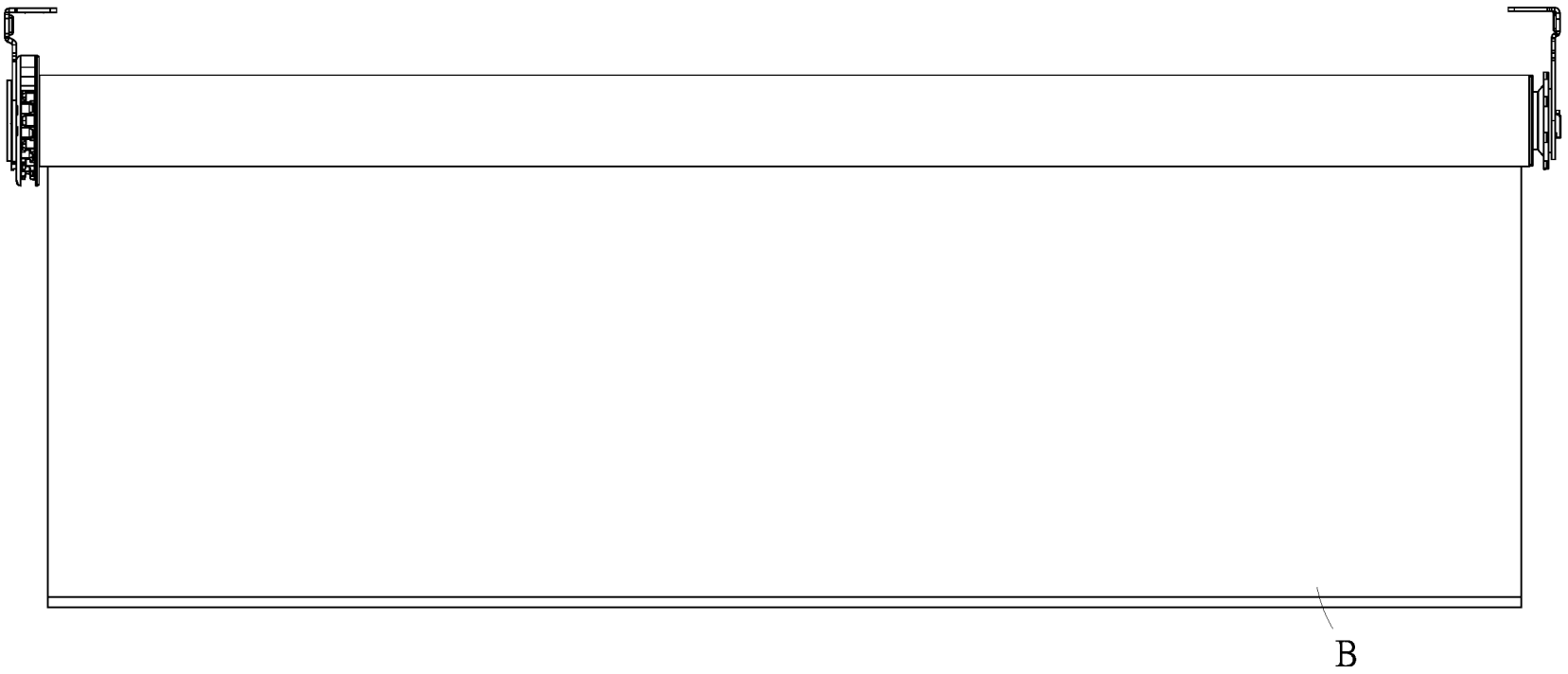
FIG. 14 shows yet another application of the roller blind in FIG. 1, with the blind fabric reaching an upper position limit of a different height from that in FIG. 12.

Referring to FIG. 13 and FIG. 14, the position of the third sliding base 341 can be adjusted after the minimum exposed length of the blind fabric B (i.e., the length of the blind fabric B that is left exposed when the blind fabric B reaches the upper position limit) is determined. Assume the original position of the third sliding base 341 allows the blind fabric B to be reeled in completely. If the third sliding base 341 is moved toward the second sliding base 331 by, for example, a distance that is ten times the lead of the second threaded portion 321 of the first sliding base 32 with respect to the first threaded portion 311 of the inner tube 31 (i.e., the distance for which the first sliding base 32 can advance along the inner tube 31 by being turned 360° for ten times), and the blind fabric B is subsequently raised to the upper position limit (i.e., where the blind fabric B can be raised no more), the exposed length of the blind fabric B will be able to be wound around the outer tube 11 for ten times.

The foregoing description of the embodiment should be able to enable a full understanding of the operation, use, and effects of the present invention. The embodiment described above, however, is only a preferred one of the invention and is not intended to be restrictive of the scope of the invention. All simple equivalent changes and modifications that are based on the appended claims and the present specification should fall within the scope of the invention.

What is claimed is:

1. A damper allowing an upper position limit and a lower position limit to be set, for limiting a blind fabric in position, wherein the blind fabric is driven by a linkage assembly in order to be raised or lowered, the damper allowing the upper position limit and the lower position limit to be set, comprising:

an inner tube configured to be provided in the linkage assembly;

a first sliding base provided on the inner tube and configured to be coupled to the linkage assembly, wherein the first sliding base is configured to be driven to rotate and displace on the inner tube by the linkage assembly;

a first position-limiting base provided on the inner tube and adjacent to a first side of the first sliding base; and a second position-limiting base provided on the inner tube and adjacent to an opposite second side of the first sliding base;

wherein when the blind fabric is lowered by the linkage assembly, the first sliding base is driven to rotate and displace on the inner tube toward the first position-limiting base by the linkage assembly, and when the first sliding base is pushed against the first position-limiting base, the first position-limiting base causes the first sliding base to stop the linkage assembly from lowering the blind fabric;

wherein when the blind fabric is raised by the linkage assembly, the first sliding base is driven to rotate and displace on the inner tube toward the second position-limiting base by the linkage assembly, and when the first sliding base is pushed against the second position-limiting base, the second position-limiting base causes the first sliding base to stop the linkage assembly from raising the blind fabric.

2. The damper allowing the upper position limit and the lower position limit to be set as claimed in claim 1, wherein the first position-limiting base includes a second sliding base and a damping elastic member; the damping elastic member is provided between the inner tube and the second sliding base; when the first sliding base is pushed against the second sliding base, the damping elastic member stores damping elastic potential energy and stops the second sliding base from being rotated; and when the first sliding base is moved away from the second sliding base, the damping elastic member releases the damping elastic potential energy to restore the second sliding base in position.

3. The damper allowing the upper position limit and the lower position limit to be set as claimed in claim 1, wherein the inner tube has a first threaded portion, the first sliding base has a second threaded portion meshing with the first threaded portion of the inner tube, and the linkage assembly drives the first sliding base to rotate and displace on the inner tube along the first threaded portion toward the first position-limiting base or the second position-limiting base.

4. The damper allowing the upper position limit and the lower position limit to be set as claimed in claim 3, wherein the second position-limiting base includes a third sliding base and a securing member, the securing member is provided at the third sliding base and abuts against the first threaded portion of the inner tube, and when the first sliding base is pushed against the third sliding base, the securing member is pressed tightly against the first threaded portion to stop the third sliding base from being rotated.

5. The damper allowing the upper position limit and the lower position limit to be set as claimed in claim 1, wherein the first side of the first sliding base has a first coupling portion, the second side of the first sliding base has a second coupling portion, the first position-limiting base has a third coupling portion, the second position-limiting base has a fourth coupling portion, the first coupling portion of the first sliding base is coupled with the third coupling portion of the first position-limiting base when the first sliding base is pushed against the first position-limiting base, and the second coupling portion of the first sliding base is coupled with the fourth coupling portion of the second position-limiting base when the first sliding base is pushed against the second position-limiting base.

6. A roller blind allowing an upper position limit and a lower position limit to be set, for limiting a blind fabric in position, the roller blind allowing the upper position limit and the lower position limit to be set, comprising:

a linkage assembly including an outer tube configured to be connected to the blind fabric, wherein the blind fabric is driven by the outer tube to be raised or lowered;

an inner tube provided in the outer tube;

a first sliding base provided on the inner tube and coupled to the outer tube, wherein the first sliding base is driven to rotate and displace on the inner tube by the outer tube;

a first position-limiting base provided on the inner tube and adjacent to a first side of the first sliding base; and a second position-limiting base provided on the inner tube and adjacent to an opposite second side of the first sliding base;

wherein when the blind fabric is lowered by the linkage assembly, the first sliding base is driven to rotate and displace on the inner tube toward the first position-limiting base by the outer tube, and once pushed against the first position-limiting base, the first sliding base drives the outer tube to stop the linkage assembly from lowering the blind fabric;

wherein when the blind fabric is raised by the linkage assembly, the first sliding base is driven to rotate and displace on the inner tube toward the second position-limiting base by the outer tube, and once pushed against the second position-limiting base, the first sliding base drives the outer tube to stop the linkage assembly from raising the blind fabric.

7. The roller blind allowing the upper position limit and the lower position limit to be set as claimed in claim 6, wherein the first position-limiting base includes a second sliding base and a damping elastic member; the damping elastic member is provided between the inner tube and the second sliding base; when the first sliding base is pushed against the second sliding base, the damping elastic member stores damping elastic potential energy and stops the second sliding base from being rotated; and when the first sliding base is moved away from the second sliding base, the damping elastic member releases the damping elastic potential energy to restore the second sliding base in position.

8. The roller blind allowing the upper position limit and the lower position limit to be set as claimed in claim 6, wherein the outer tube has a position-limiting ridge, the inner tube has a first threaded portion, the first sliding base has a position-limiting portion corresponding to the position-limiting ridge and a second threaded portion meshing with the first threaded portion of the inner tube, and when rotated, the outer tube drives the first sliding base to rotate and displace on the inner tube along the first threaded portion and the position-limiting ridge.

9. The roller blind allowing the upper position limit and the lower position limit to be set as claimed in claim 8, wherein the second position-limiting base includes a third sliding base and a securing member, the securing member is provided on the third sliding base and abuts against the first threaded portion of the inner tube, and when the first sliding base is pushed against the third sliding base, the securing member is pressed tightly against the first threaded portion to stop the third sliding base from being rotated.

10. The roller blind allowing the upper position limit and the lower position limit to be set as claimed in claim 6, wherein the first side of the first sliding base has a first coupling portion, the second side of the first sliding base has a second coupling portion, the first position-limiting base has a third coupling portion, the second position-limiting base has a fourth coupling portion, the first coupling portion of the first sliding base is coupled with the third coupling portion of the first position-limiting base when the first sliding base is pushed against the first position-limiting base, and the second coupling portion of the first sliding base is coupled with the fourth coupling portion of the second position-limiting base when the first sliding base is pushed against the second position-limiting base.

* * * * *